US005464150A

United States Patent [19]

Porres Sanchez et al.

[11] Patent Number: 5,464,150

[45] Date of Patent: Nov. 7, 1995

[54] TWO CHAMBER CONTAINER FOR SEPARATE SOLID AND/OR LIQUID FOOD PRODUCTS

[76] Inventors: Francisco Porres Sanchez; Maria M. Barrufet Barque, both of Paris, 177-2 º-2ª, 08036 Barcelona, Spain

[21] Appl. No.: 310,286

[22] Filed: Sep. 21, 1994

[30] Foreign Application Priority Data

May 4, 1994 [ES] Spain ..... 9401204

[51] Int. Cl.[6] ..... B65D 13/00

[52] U.S. Cl. ..... 229/120.38; 426/115; 426/120; 229/904; 206/561; 206/562

[58] Field of Search ..... 426/112, 115, 426/120; 206/217, 541, 561, 562; 229/120.38, 902, 904

[56] References Cited

U.S. PATENT DOCUMENTS

| | | | |
|---|---|---|---|
| 3,094,264 | 6/1963 | Petrone | 206/562 |
| 3,115,251 | 12/1963 | Farrell | 206/562 X |
| 3,201,024 | 8/1965 | Brokop | 206/562 |
| 3,899,119 | 8/1975 | Roccaforte | 206/562 |
| 3,955,672 | 5/1976 | Brundage | 206/562 |
| 4,497,433 | 2/1985 | Wischusen, III | 206/562 X |
| 4,511,042 | 4/1985 | Wischusen, III | 206/562 X |
| 4,705,173 | 11/1987 | Forbes, Jr. | 229/904 X |
| 4,895,259 | 1/1990 | Paley | 229/904 X |
| 4,981,217 | 1/1991 | Lim | 206/561 |
| 5,110,170 | 5/1992 | Boatwright | 206/562 X |
| 5,205,474 | 4/1993 | Stuart et al. | 229/904 X |
| 5,259,528 | 11/1993 | Pall et al. | 206/561 X |
| 5,301,871 | 4/1994 | Gross et al. | 229/904 X |

*Primary Examiner*—Donald E. Czaja
*Assistant Examiner*—Milton I. Cano
*Attorney, Agent, or Firm*—Ostrolenk, Faber, Gerb & Soffen

[57] ABSTRACT

Container for separate solid and/or liquid food products which includes a shaped and reinforced prismatic body of a pasteboard template, having a mouth opening on an inclined plane and having larger side faces provided with identical opposing cuts. A pasteboard template, generally in the form of a "C", having an upper leg which defines an upper end surface with a cutout in it, is introduced inside the prismatic body. The upper end surface also has opposite lateral surface extensions that extend over the larger side faces and, two lips, are introduced into the cuts on the larger side faces which attaches the template to the prismatic body. The vertical wall of the "C"-shaped template is a partition that divides the interior of the prismatic body into an area to hold the solid product, while a receptacle with a liquid in it is introduced into the cited cutout in the upper end surface.

5 Claims, 1 Drawing Sheet

TWO CHAMBER CONTAINER FOR SEPARATE SOLID AND/OR LIQUID FOOD PRODUCTS

BACKGROUND OF THE INVENTION

The present invention concerns a container for solid and/or liquid food products that are separated within the container.

At the present time, there are no known containers of this type used both to contain solid food products, for example, french fried potatoes, and some kind of sauce, for example. In another example, instead of sauces, there might be a container for a refreshing beverage.

SUMMARY OF THE INVENTION

The container of the invention is very simple to produce since it is defined by two templates made of cardboard or pasteboard and therefore flexible, one of them defines the body of the container as such. The other is attached inside the container in order to define a type of support and also to separate the body of the container itself.

In any event, the solid and the liquid items do not mix inside the container.

The advantages presented by the container of the invention are substantial in terms of the function, operation and use of the container, because the user can hold the container with one hand while manipulating the food and eating it with the other hand, and he can also drink the liquid contained in a receptacle arranged inside the container itself.

The container according to the invention is also very practical to use at sports and other types of events outside the home, since the container can be crushed and placed in a trash basket after use.

According to the invention, the container preferably has a prismatic shaped body and is equipped at its top with an opening on an inclined plane. On two larger, opposing side faces of the body, there are two identical cuts, which also face one another. The bottom of the prismatic body is formed of flaps with a reinforcing system that works together with it and some cut and fold lines.

The container also has a second template, which is preferably rectangular in shape, with fold lines that form a straight sided, generally "C"-shaped portion. One of its legs, i.e. the upper one, has a cutout part in its center that can be circular, triangular, quadrangular or, by extension, polygonal. Through that cutout, a receptacle containing a refreshing beverage, for example, is installed.

The area where the cutout appears also has some opposing, flap type, lateral surface extensions that are mounted over the outside of the larger faces of the container body and are introduced through the cuts made in these faces by means of respective lips which, in this coupling, anchor the "C"-shaped template inside the container body.

The inside front or lower part of the container is used to hold solid food products such as french fries, popcorn, etc.

Other features and advantages of the present invention will become apparent from the following description of the invention which refers to the accompanying drawings.

BRIEF DESCRIPTION OF THE DRAWINGS

In order to understand more readily not only the construction but also the use of the container of the invention, an embodiment is presented merely for purposes of illustration and not to limit the execution, as shown in the attached drawings, in which.

DETAILED DESCRIPTION OF A PREFERRED EMBODIMENT

Figure 1:
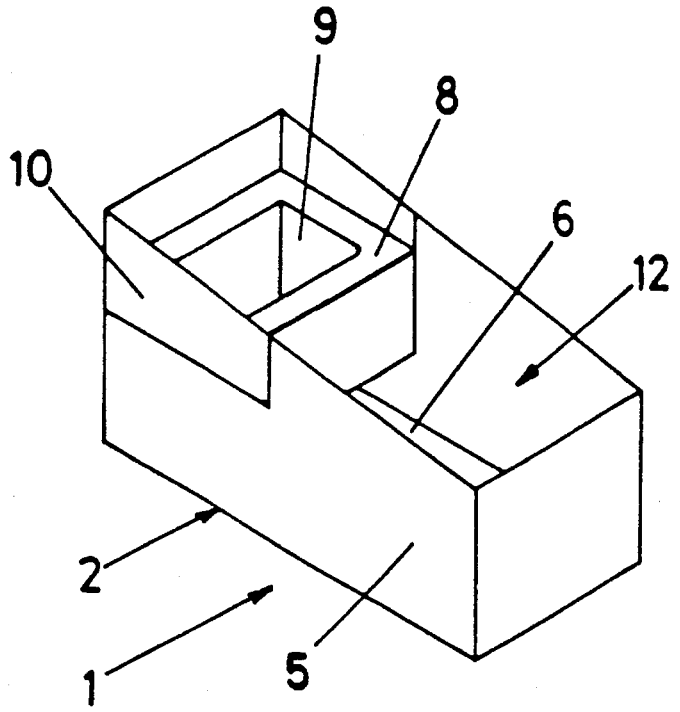
FIG. 1 is a perspective view of the container of the invention.
Figure 2:
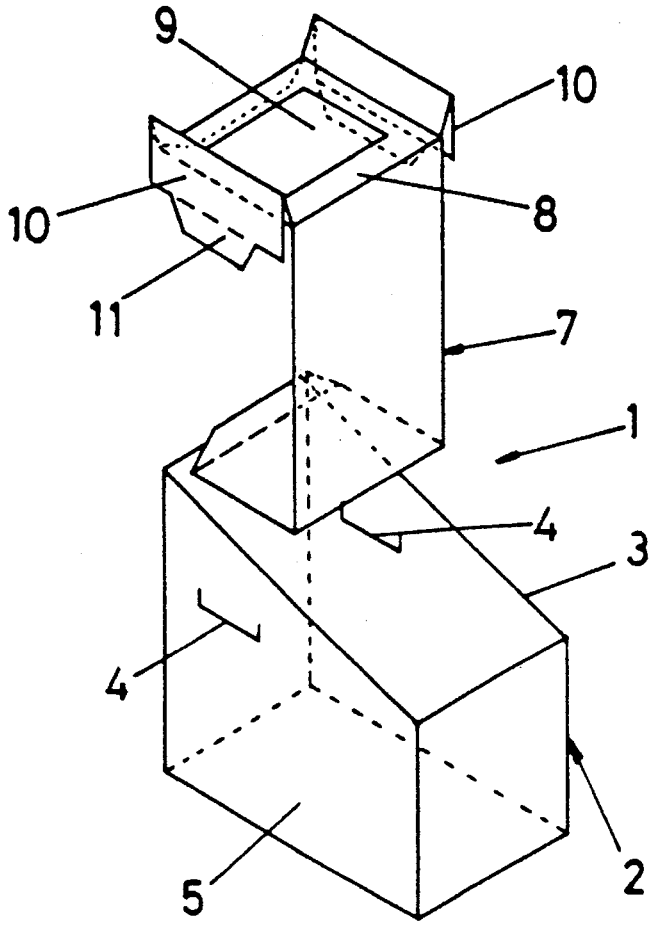
FIG. 2 is an exploded view of the two parts of the container.

The container 1 includes a prismatic body 2 having a top side mouth opening 3 which is on an inclined plane with reference to the plane of the opposite side and the ends of the body which the inclined side intersects. The prismatic body 2 has at least one cut 4 into each of its larger side faces 5.

The prismatic body 2 is defined preferably by a pasteboard template. Its bottom 6 is delimited by some reinforced flaps.

Inside the body 2 of the container there is a template 7 which is folded generally in the shape of a "C". The template 7 has a lower leg disposed toward the bottom 6 of the housing body 2. It has an upper leg which defines the upper surface 8 of that template. A cutout 9 defined in the upper leg can be formed in any shape, regular or irregular, circular or polygonal.

The upper surface 8 has folded up lateral extensions 10 along its opposite lateral sides that extend over the larger side faces 5 of the body 2. These extensions terminate in lips 11 that are shaped to fit into and are introduced into the respective cut 4 on each side face. This anchors the template 7 in the body 2 and it also stiffens and reinforces the container. The upstanding central leg of the C-shape between its lower and upper legs is disposed on the side in toward the opening in the body, whereby the central leg defines a separation between one receptacle enclosed by the "C" and having the cutout 9 as its top entrance and a second receptacle outside the C-shape, e.g. for holding solid food.

In the cutout 9 a container (not shown) may be installed that holds a beverage, not shown, while a solid food product, such as french fried potatoes, etc., is placed in the other anterior part 12.

Although the present invention has been described in relation to a particular embodiment. thereof, many other variations and modifications and other uses will become apparent to those skilled in the art. It is preferred, therefore, that the present invention be limited not by the specific disclosure herein, but only by the appended claims.

What is claimed is:

1. A container for separating food products comprising:

a prismatic body having a plurality of sides including a bottom side and an opposite open side, with the open side being on an inclined plane with respect to the bottom side; the body having opposite larger side faces extending up to the open side; a cut formed in at least one of the side faces;

a template generally shaped in the form of a "C" and installed in the body down from the open side, a bottom leg of the "C" inside the body, an upstanding vertical face of the "C" defining a partition inside the body for separating the body into a portion outside the "C" and a portion enclosed by the "C" and a top leg of the "C" defining an upper end surface of the template at the open side;

a cutout defined in the upper end surface of the template for receiving a food product through the cutout to be held in the portion of the body enclosed by the template;

a lateral surface extension defined at the upper leg of the template corresponding to at least one side face of the body at which the cut is defined, for supporting the template at the respective side face; a lip on the lateral surface extension introducible into the cut on the side face for attaching the template to the body.

2. The container of claim 1, wherein the each of larger side faces has a respective cut therein; a respective lateral surface extension at the upper end surface at both of the larger side faces for extending along the respective side faces, a respective lip on each of the lateral surface extensions being introducible in the respective cut in each of the larger side faces for holding the template in position in the body.

3. The container of claim 2, wherein the cuts in the larger side faces are identical and opposing cuts.

4. The container of claim 3, wherein the body is of a reinforced paste board second template and the first mentioned C-shaped template is also of paste board.

5. The container of claim 1, wherein the body is of a reinforced paste board second template and the first mentioned C-shaped template is also of paste board.

* * * * *